United States Patent [19]

Chang

[11] Patent Number: 5,067,662

[45] Date of Patent: Nov. 26, 1991

[54] BOWL TYPE GRINDING MILL

[76] Inventor: Shien F. Chang, 150 West 51st, Suite 806, New York, N.Y. 10019

[21] Appl. No.: 545,032

[22] Filed: Jun. 28, 1990

Related U.S. Application Data

[63] Continuation-in-part of Ser. No. 348,028, May 4, 1989, abandoned, which is a continuation-in-part of Ser. No. 316,160, Feb. 28, 1989, abandoned.

[51] Int. Cl.[5] ..... B02C 23/30

[52] U.S. Cl. ..... 241/56; 241/79.1; 241/119; 241/121; 241/285 B

[58] Field of Search ..... 241/117–121, 241/53, 56, 79.1, 129, 101.3, 285 R, 285 A, 285 B

[56] References Cited

U.S. PATENT DOCUMENTS

| | | | |
|---|---|---|---|
| 2,112,359 | 3/1938 | Crites | 241/121 X |
| 2,431,746 | 12/1947 | Frangquist | 241/53 |
| 2,909,330 | 10/1959 | Hardinge | 241/121 X |
| 3,955,766 | 5/1976 | Chang | 241/56 |
| 4,483,487 | 11/1984 | Katsuta et al. | 241/121 |
| 4,682,738 | 7/1987 | Chang | 241/56 |

*Primary Examiner*—Mark Rosenbaum

[57] ABSTRACT

A grinding mill comprising a mill cylinder, a vertically mounted main shaft coupled at the lower end to a motor mounted on the lower side of the mill cylinder to be driven thereby and extending along the axis of the mill cylinder, and means mounted in descending order on the main shaft including a finished product conveying means, a classifying means, a grinding roller means and a decelerating means, a fixed sleeve fixed on the bottom of the mill cylinder to support a rotary bushing by means of bearings, a circular seat portion and a support seat fixed to the upper end of the rotary bushing, wherein the support seat is fixed with a grinding ring, a plurality of grinding rollers are rotatably provided inward of the grinding ring, a clearance is formed between the grinding ring and the grinding rollers, wherein a plurality of radially extended sweeping sheets are provided outside of the circular seat portion for sweeping the material fallen upon it away from the mill, and wherein an air inlet duct is provided at the inner surface of the mill cylinder for directing air into a grinding chamber.

8 Claims, 9 Drawing Sheets

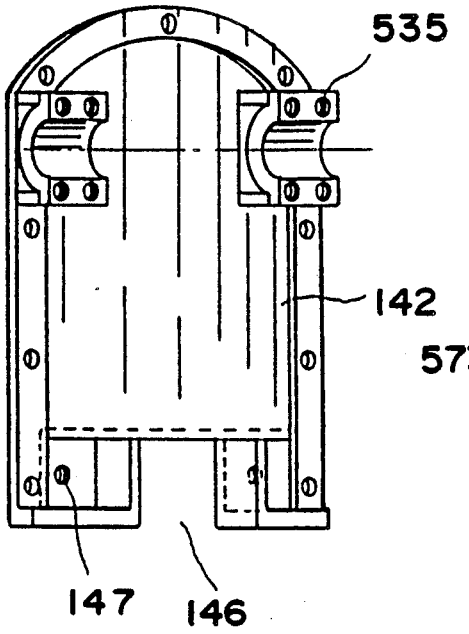
FIG. 4-A
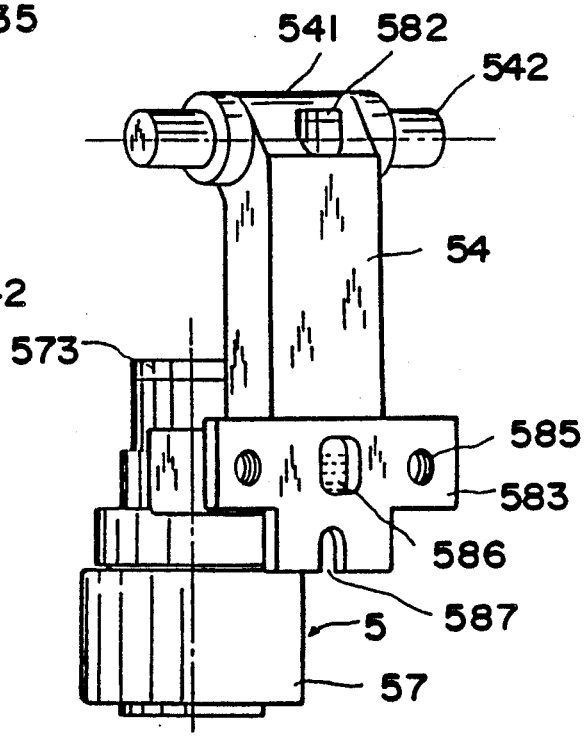
FIG. 3-A

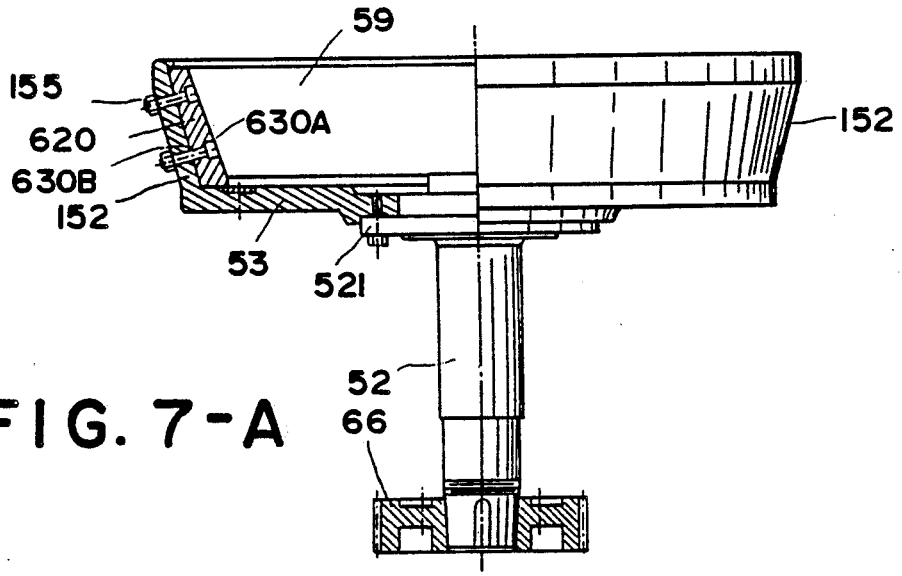
FIG. 7-A
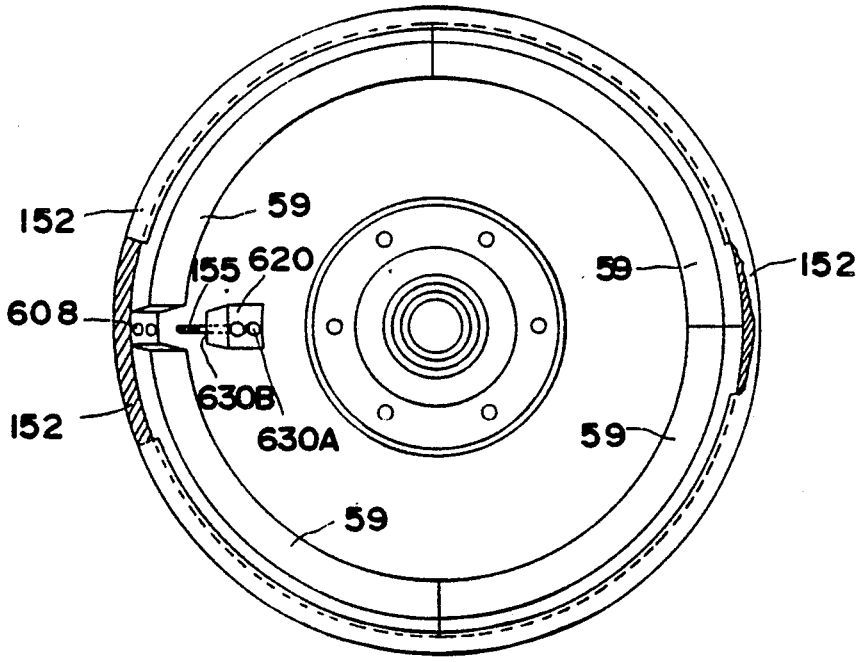
FIG. 8-A

BOWL TYPE GRINDING MILL

This is a continuation-in-part of the application filed on May 4, 1989, titled "Bowl Type Grinding Mill," of Ser. No. 07/348,028, which is a continuation-in-part of the application filed on Feb. 28, 1989, titled "Bowl Type Grinding Mill", of Ser. No. 07/316,160, now abandoned.

BACKGROUND OF INVENTION

The present invention relates to grinding mills, and particularly to bowl-type grinding mills incorporating in a mill cylinder a decelerating means, a grinding roller means, a classifying means, and a finished product conveying means. A motor drives the said means by a single shaft. This mill is suitable for efficiently grinding materials such as soft or hard ores (e.g. coal for power plant, or ore for making cement), viscous material, or fibrous material, to a desired fineness.

Typical of known roller mills is the Raymond ring-roller mill, which is vertically mounted and contains therein a centrifugal grinding roller device and a fixed separator. The grinding roller device is operated by a drive means mounted outside the mill through a speed reducing means, drive means, and a horizontal drive shaft. A blower, also mounted outside the mill, is used for creating an upward air stream in the mill to sweep finely ground material or particles through the fixed separate vanes of the separator into a discharge pipe. Such a mill is rather complicated in construction and difficult to maintain and repair. It also occupies a large space, and requires high power. In operation the mill presents further problems such as vibration, noise, and dust clouds. Moreover, as far as grinding efficiency is concerned, particles finer than 300 U.S. standard mesh can hardly be produced, and grinding fibrous and viscous raw materials can be difficult.

In order to overcome the above disadvantages, the inventor provides the kinds of improved roller mills that were described in U.S. Pat. Nos. 3,955,766; 2,112,359; 2,431,746; 4,483,487; 2,909,330; and 4,682,738.

In U.S. Pat. No. 3,955,766, mounted in ascending order in this roller mill are a speed reducer device, a centrifugal grinding roller device, a classifier device and dust collector device. All the devices are driven by a single vertical shaft that is driven by an electric motor mounted on top of the mill so as to obviate the need for a drive means, driven means and blower located outside the mill. This not only renders the mill simple in construction and compact in size, but can also increase grinding efficiency. Furthermore, the roller mill is suitable for grinding various raw materials including solid, fibrous, and viscous materials, with the finished particles being finer than 1,000 mesh.

While that roller mill enjoys several advantages over the previously described ring-roller mill, the inventor has performed subsequent experiments and has found that although there is no denying the fact that using centrifugal force resulting from rotating rollers as the grinding force yields positive grinding effects, the centrifugal force varies in accordance with the rotational speed and weight of the rollers and thus may result in different grinding forces. Under normal low-speed operating conditions, the rollers will not cause any problem. However, if the rotational speed of the rollers is increased in order to facilitate grinding of the raw materials or to obtain greater capacity or output, an excessively high grinding pressure results from the increased centrifugal force due to the increase in rotational speed of the rollers. The excessively high grinding pressure tends to compress part of the ground fine particles into flakes which may adhere to the grinding ring and the peripheral wall of the rollers or drop down on the bottom of the mill instead of being carried in an air stream to the classifier. Also, the excessively high grinding pressure often gives rise to great vibration, noise, and wear of the rollers and the grinding ring by subjecting both to crushing and friction. In addition, since there is no clearance between the centrifugal rollers and the grinding ring and relatively high power is required to start operation due to the great friction and vibration at the time of actuation. Especially, in case of an unexpected loss of power during operation, it will be extremely difficult to re-start the rollers after the power supply resumes unless the raw material already fed into the mill has been cleared away, since the internal working parts of the mill are fully loaded. In addition, since the aforesaid rollers are each held in suspension by a support arm, when the rollers need repairing or replacing due to wear, the support arm and the shaft of the associated roller must be disassembled as a whole so that roller can be removed, thus inconveniencing maintenance and repair work. Further, the support arm occupies so large a space that not only is the effective working space in the separation chamber diminished, but the support arm, when rotating, also hinders the formation of an upwardly spiralling flow of ground particles and air below it to such an extent that the particles come together and cause the grinder to become plugged.

U.S. Pat. No. 4,682,738 disclosed a vertical centrifugal ring-roller mill comprising among others, a grinding roller means having many elements which are rotated as a unit. The pressure of grinding is determined by the speed of the rotation of the roller means and the weight thereof. When maintenance is to be done, the whole grinding mill must be stopped in order to inspect the amount of oil and degree of wearing in the grinding rollers. This is time consuming and inconvenient. The amount of oil and degree of wearing cannot be monitored externally.

Therefore, the main object of the present invention is to eliminate the above mentioned disadvantages by providing a kind of bowl-type grinding mill comprising mainly a decelerating means, a grinding roller means, means for adjusting the clearance between grinding ring and rollers, a classifying means, a finished product conveying means, a motor, and a transmission means, wherein the grinding rollers and the grinding ring can be of different degrees with respect to a center axis of the grinding mill to 90° or other appropriate degrees according to the rotating speed and the horsepower of the grinding mill, and moreover, the assembly, maintenance, adjustment, or the replacement and adding of the oil is all made easy.

Another object of the present invention is to provide a bowl-type grinding mill, wherein the classifying means comprises a plurality of separate blades which are disposed obliquely and radially and positioned easily so that ground particles and air can pass through the separate blades perpendicularly and the separation thereof is made easy.

A further object of the present invention is to provide a grinding mill, wherein a spring or hydraulic device for pressurizing a pressure plate is provided outside of a grinding mill cylinder so that the pressure of the grinding rollers (i.e., the clearance between grinding ring and rollers) can be adjusted externally during operation and such that the efficiency of grinding can be raised and the wear of the parts can be reduced.

Still another object of the present invention is to provide a grinding mill, wherein a grinding roller support plate is provided in the grinding mechanism, the support plate can also serve as an oil reservoir, an oil inspection stick is provided on the upper part of the support plate, a transparent glass is provided on the lower part of the support plate so as to monitor the amount of oil in the grinding mechanism.

Another object of the present invention is to provide a grinding mill, wherein the grinding ring comprises several grinding ring pieces, said pieces are positioned in an annular grinding ring seat with wedge-shaped fixing blocks which are secured to the seat with several nuts, with the leading end of the nuts approximately facing radially outwardly and thus the nuts will not be loosened during operation, and on the contrary, will be fastened more tightly because of the pressurizing force imparted thereupon by the grinding rollers and the eccentric force imposed thereupon during operation.

Another object of the present invention is to provide a grinding mill, wherein the motor is horizontally fastened to one lower side of the mill and exerts a force to the mill through a vertical main shaft which extends along the axis of a grinding mill cylinder.

Another object of the present invention is to provide a grinding mill which is simple in construction, compact in size, occupies a small mounting area, requires low power, starts easily, and creates a minimum of noise and vibration.

A further object of the present invention is to provide a grinding mill in which the main transmission mechanism and grinding roller means are placed outside of the mill cylinder and a classifying chamber is formed in the upper portion of the mill cylinder and a classifying chamber is formed in the upper portion of the mill cylinder so that the mill has a low center of gravity and smooth, uninterrupted flow of ground particles and air is ensured.

Another object of the present invention is to provide a grinding mill, wherein there is no mechanism above the rollers which may hinder the assembly and disassembly of the rollers or the separation of ground particles and air.

Another object of the present invention is to provide a grinding mill suitable for grinding solid (ores), fibrous and viscous raw materials.

Another object of the present invention is to provide a grinding mill which enables the user to grind the raw material to the desired fineness by adjusting externally the clearance between grinding ring and rollers while minimizing noise and vibration.

Other objects and features of the invention will be apparent from the following description with reference to the accompanying drawings, in which:

FIG. 2 is a top view, partly in cross section, of the grinding mill;

Figure 4:
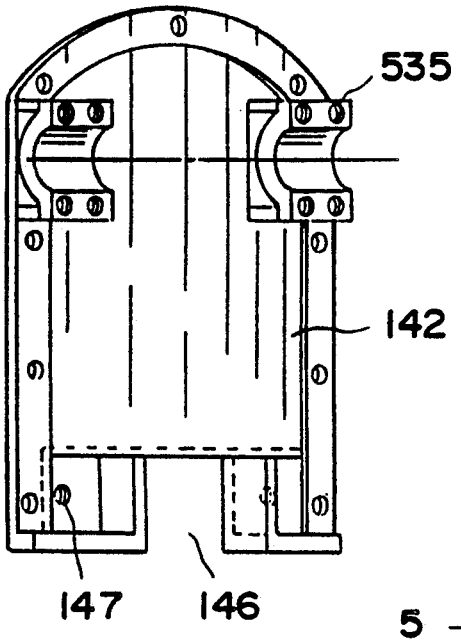
Figure 3:
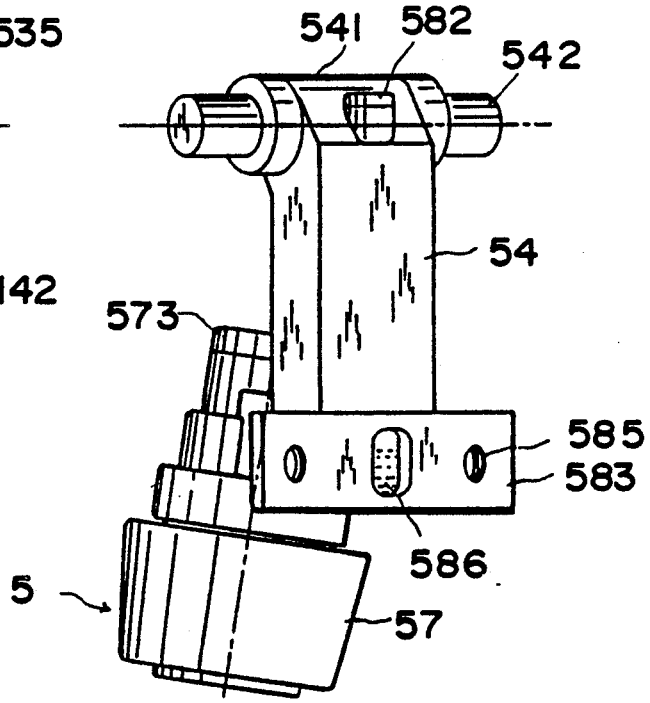
Figure 5:
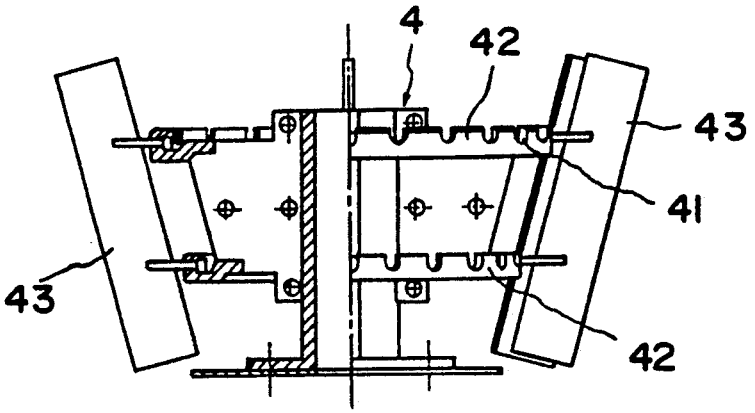
Figure 6:
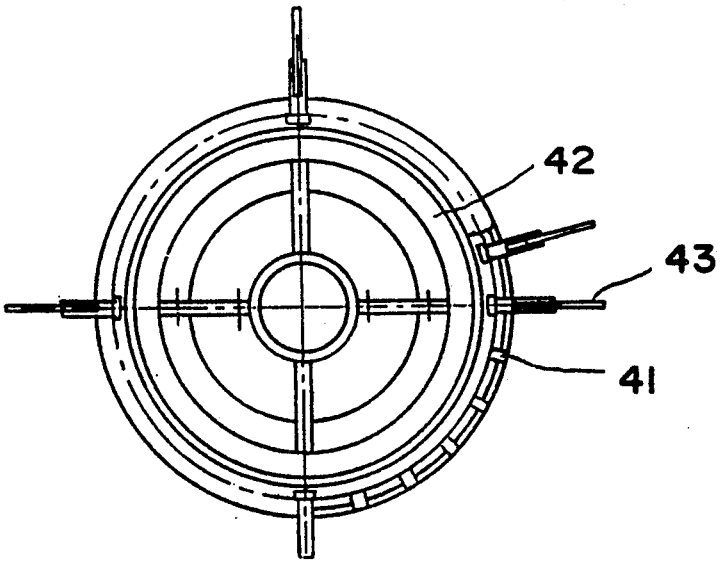
Figure 7:
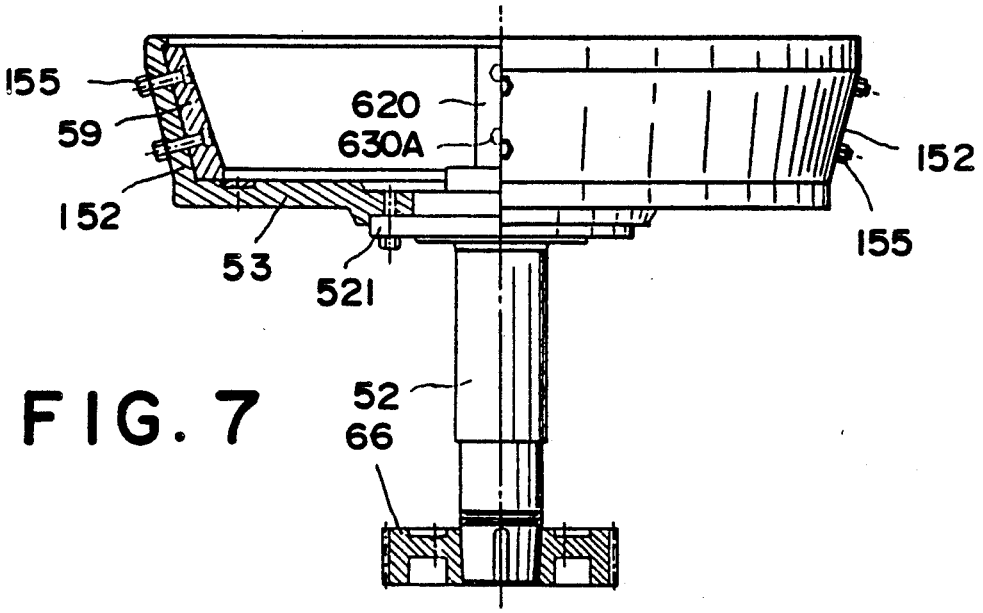
Figure 8:
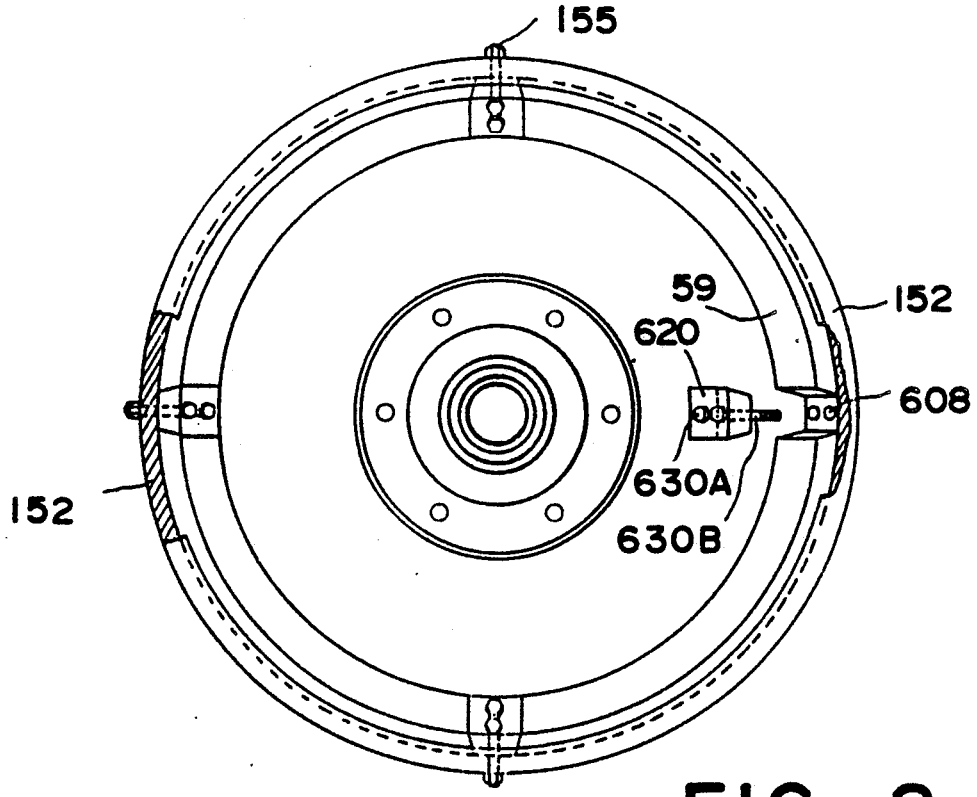

FIG. 3 and FIG. 3-A are perspective views showing mainly the embodiments of a grinding roller and roller support plates used in the present invention;

FIG. 4 and FIG. 4-A are perspective views showing two embodiments of an inspection door used in the present invention:

FIG. 5 is an elevational view, partly in section, of a classifying means for the grinding mill;

FIG. 6 is a top view of the classifying means shown in FIG. 5;

FIG. 7 is a partial section elevational view of the grinding mill;

FIG. 8 is a partial sectional top view of the grinding mill; and

FIGS. 7A and 8A show another embodiment which is different from that shown in FIGS. 7 and 8.

DETAILED DESCRIPTION OF PREFERRED EMBODIMENT

Figure 1:
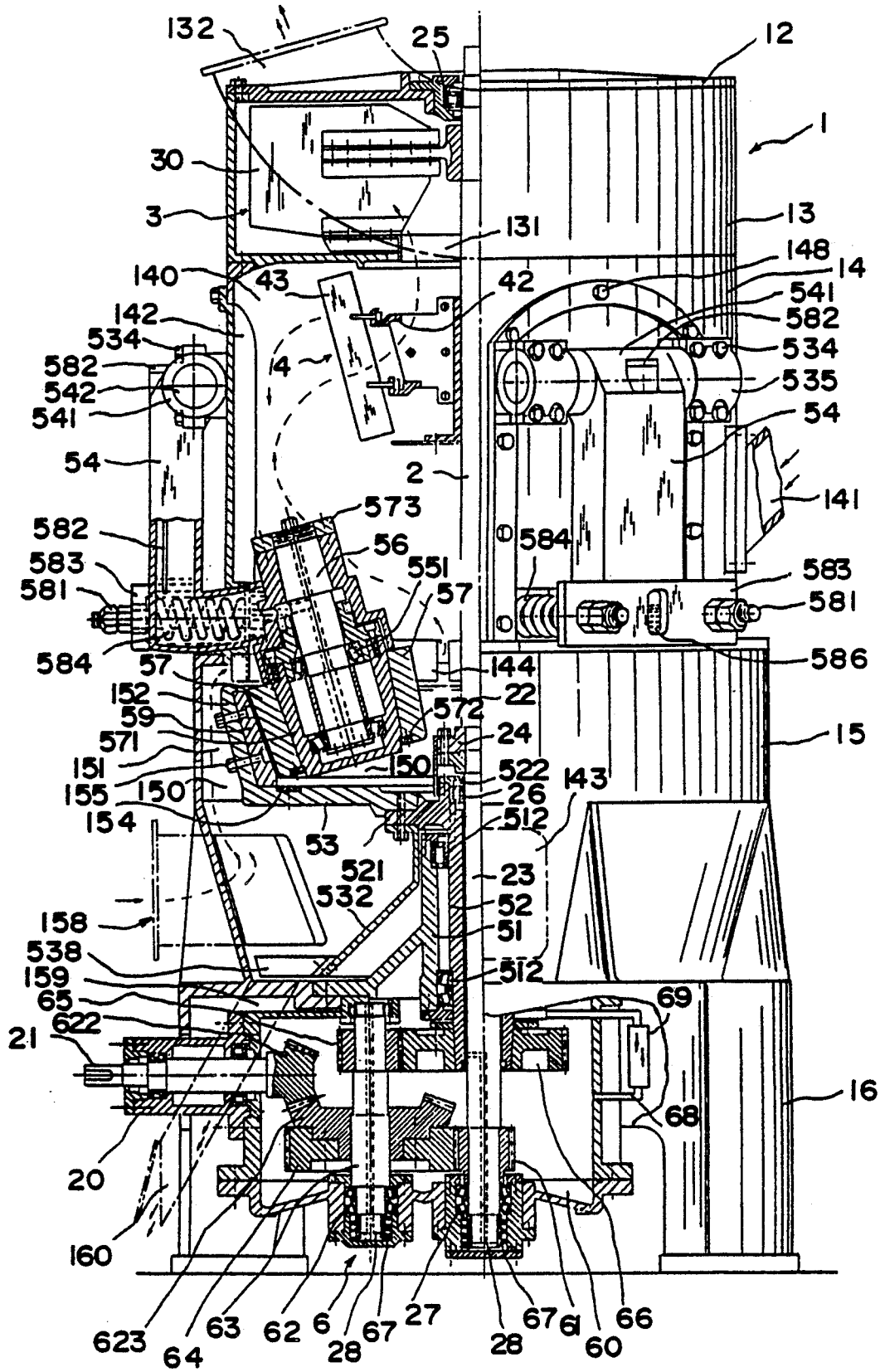
FIG. 1, FIG. 1-1 and FIG. 1-2 are elevational views, partly in longitudinal section, of three embodiments of a grinding mill according to the present invention.
Figure 1:
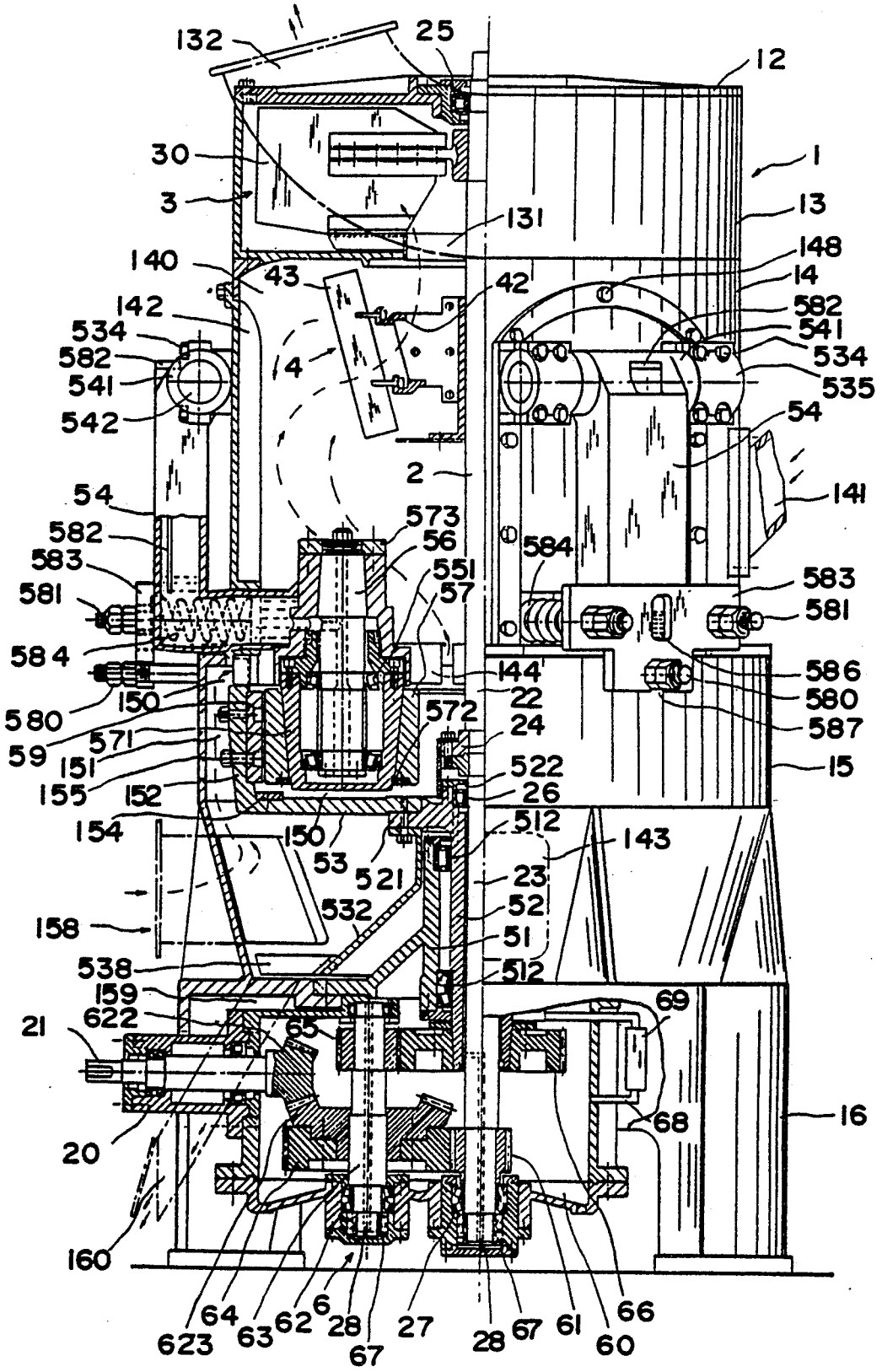
Figures 1, 2:
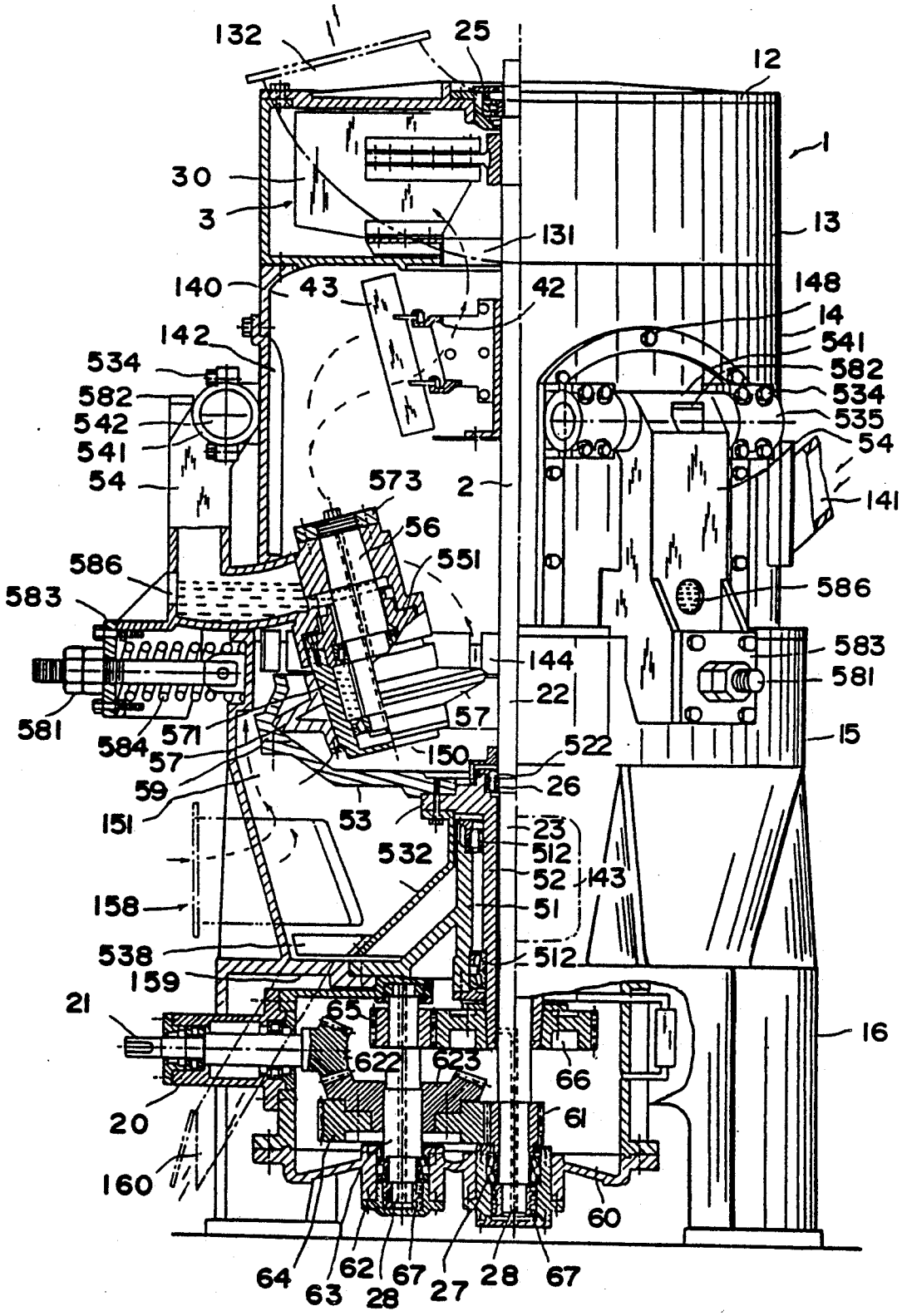
Figure 2:
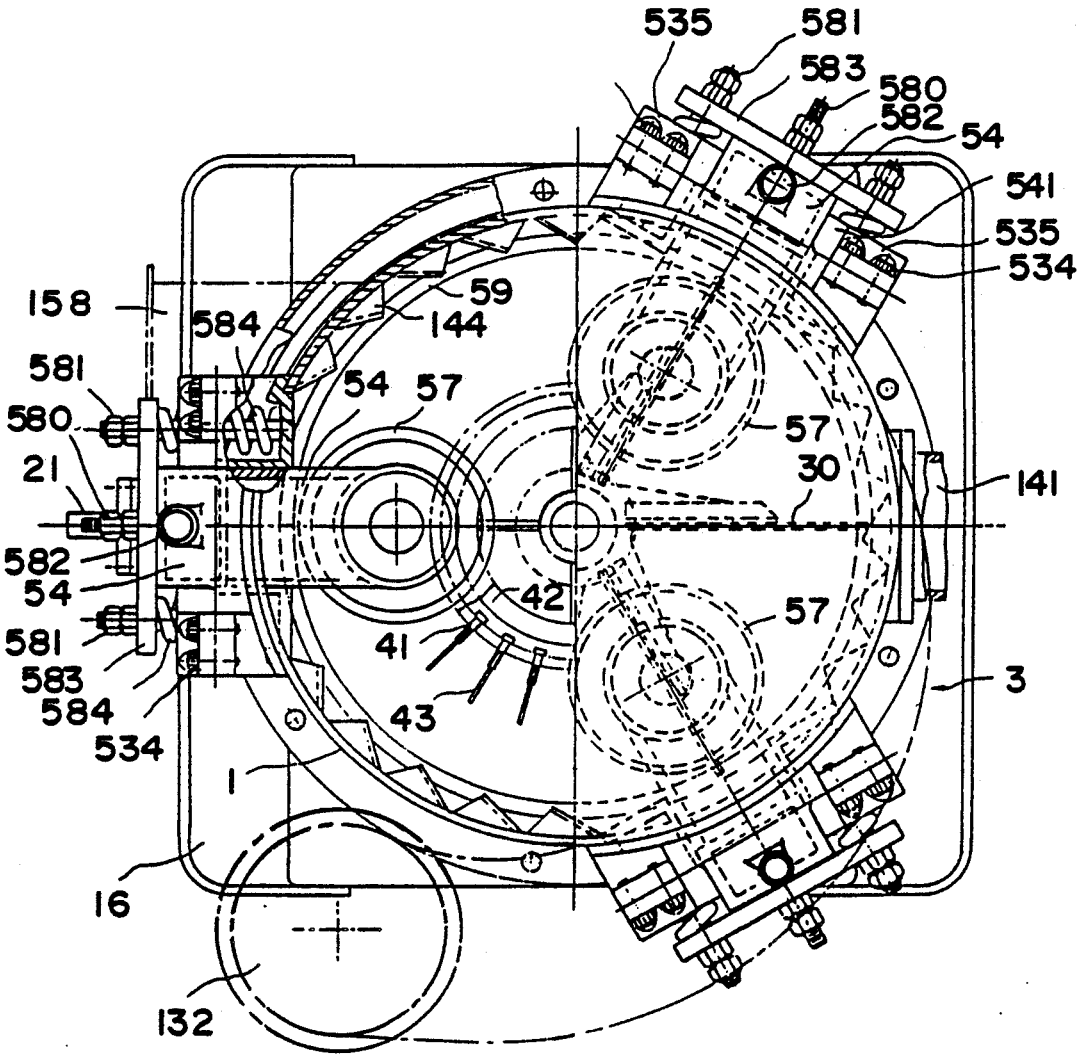

As shown in FIGS. 1 and 2, there is depicted a grinding mill 1 comprising from top to bottom a top cover 12, an upper mill cylinder 13, a central mill cylinder 14, a lower mill cylinder 15 and a mill support frame 16.

A motor (not shown in the drawings) is horizontally (transversely) fastened to one side of the mill support frame 16. The output shaft of this motor is connected with a shaft 21 which is extended into a decelerating means 6 through a support seat 20 and fixed therewith. The decelerating means 6 includes gears 622, 623, 64 (which are fixed to a shaft 63), 61, and 66. These gears will be described in detail thereafter. A main shaft 2 extends vertically along the axis of a grinding mill cylinder 1..

For the purposes of easy manufacture and installation, the main shaft 2 is made in two sections, i.e., an upper shaft 22 and a lower shaft section 23, joined together by a coupling 24. The upper shaft section 22 is supported at the upper end by thrust bearing 25 provided at the center of the top cover 12, while the lower shaft section 23 is supported at opposite ends by thrust bearings 26 and 27 which are provided, respectively, at the upper end of a rotary bushing 52 which will be described herein and at the lower end of a gear box 60 located under the lower mill cylinder 15 within the mill support frame 16. The lower end of the lower shaft section 23 extends through the bottom end of the lower mill cylinder 15 into the gear box 60.

Mounted in descending order on the main shaft 2 are a finished product conveying means 3, a classifying means 4, a grinding roller means 5 and a decelerating means 6, all being driven by the main shaft 2.

The finished product conveying means 3 is located within the upper mill cylinder 13 and comprises a fan 30 composed of a plurality of vanes 31 and coupled to the main shaft 2. The upper mill cylinder 13 has at the bottom an inlet 131 for the passage of finished product and air and a voluted exhaust pipe 132 extending outwardly and upwardly from the rear of the upper mill cylinder, so that the fan 30 and the upper mill cylinder may function as a blower for sucking and discharging the finished product within the mill cylinder 1.

The classifying means 4 (FIG. 5) is located in a separation room 140 in the upper part of the central mill cylinder 14 and comprises an obliquely positioned double-disk rotary member 42 coupled to the main shaft 2 and formed with a plurality of obliquely and radially disposed separate blades 43 removably engaged along one side within the plurality of notches 41 in the discs of the rotary member 42. A round plate is fixed to the lower end of the axis of the rotary member 42. The central mill cylinder 14 is further provided with a feed inlet 141 at one side.

A grinding roller means 5 is mounted on the central mill cylinder 14 enclosing a grinding chamber 150 in which the grinding of raw material is carried out. Part of the outer wall of the central mill cylinder 14 can form an inspection door 142. Please refer specifically FIG. 3, 3-A, 4, and 4-A. The grinding roller means 5 has a fixed sleeve 51 which is fixed at the outer wall of the central mill cylinder 14 and surrounds the lower shaft section 23 of the main shaft 2. The fixed sleeve 51 is provided therein with a thrust bearing 512 at opposite ends thereof. A rotary bushing 52 having a bearing 26 and radial cylindrical flange 521 on the upper end surrounds the lower shaft section 23 and interposed within the fixed sleeve 51. The rotary bushing 52 is spaced apart from the lower shaft section 23 and is rotatable within the fixed sleeve 51 by virtue of the thrust bearing 512. A support seat 53 and a grinding ring seat 152 are loosely fitted around the fixed sleeve 51 and fastened by bolts to the upper flange 521 of the rotary bushing 52 so as to be rotatable therewith. An annular liner 154 is placed on the support seat 53. A grinding ring 59 is of annular shape and comprised of a plurality of pieces (e.g., 4 pieces in the embodiment shown in FIGS. 7 and 8). These pieces are disposed in an alternate manner with an equal number of wedge-shaped fixing blocks 620, each of which are formed with a hexagonal nut seat **630*a* and two round holes 630*b* so that two bolts 155 can be inserted approximately radially and outwardly into the holes 630*b* and through holes 608 on the grinding ring seat 152 and fastened with nuts. There is a small clearance between the grinding ring 59 and the grinding rollers 57**.

In the embodiment shown in FIGS. 7A and 8A, one piece of wedge-shaped fixing block 620 will suffice so as to save labor when manufacturing, mounting, or dismounting.

A plurality of sweeping sheets 538 are provided equidistantly and radially around a circular seat portion 532 under the support seat 53. The sweeping sheets 538 can sweep the material fallen upon it out of the grinding mill. A plurality of inspection doors 142 are fastened to the central mill cylinder 14. The lower ends of the inspection doors 142 are provided with cutoff portions 146 (FIG. 4). Pressurizing means 147 for imparting pressure to the grinding rollers 57 are provided on both sides of the cutoff portions 146 on the inspection doors 142. The pressurizing means 147 can be spring means or hydraulic means 584 which can be adjusted with screws 580 and 581. A plurality of grinding roller support plates 54 can pivot radially inwardly and outwardly so as to adjust and set the radial clearance between the grinding rollers 57 and the grinding ring 59. The lower ends of the support plates 54 are provided with pressure plates 583 which have screw bores 585 for screws 581. The pressure plates 583 are provided with cutoff portions 587 (FIG. 3-A) so that the screws 580 can pass through them and be fastened. The upper ends of the inspection doors 142 are provided with hinge members 535 which can be fitted with hinge portions 541 of the grinding roller support plates 54. A plurality of pivots 542 pass through the hinge members 535 and the hinge portions 541 so that the support plates 54 can pivot radially inwardly and outwardly. The support plates 54 are fastened with screws 534. The support plates 54 can also serve as reservoirs for oil and are provided with an oil inspection stick 582 on their upper ends, and the transparent glasses 586 on their lower ends so that the amount of the oil in the support plates 54 can be inspected. The lower ends of the support plates 54 extend inwardly into a grinding chamber 150. A roller shaft 56 is provided with a pair of thrust bearings 551. The grinding rollers 57 are rotatably and vertically or obliquely positioned at the lower portion of the support plates 54 can be checked. The grinding roller 57 fits around a roller bushing 571 which is journalled at the lower portion of the roller shaft 56 through the thrust bearings. Each grinding roller 57 and roller bushing 571 are secured together by means of a face plate 572 and screws.

An air inlet duct 151 is provided at the inner surface of the lower mill cylinder 15 for directing air into the grinding chamber 150. The inspection doors 142 are provided for the inspection, maintenance, cleaning, and adjusting of the grinding roller means. A tangential air inlet port 158 is provided on the side of the lower portion of the lower mill cylinder 15. A waste material discharge port 159 communicates with the lower mill cylinder 15.

Contained in the gear box 60 fixed in the mill support frame 16 is the decelerating means 6. The decelerating means 6 comprises a driven gear 623 driven by a gear 622 which is connected with the connecting shaft 21, a driving gear 62 fixed at the lower end of the main shaft 2, a driven gear 64 coupled to the lower part of a driven shaft 63 supported at opposite ends by bearings 62 in the gear box 60, a gear 65 fixed on the upper part of the driven shaft 63, and a gear 66 fixed on the lower end of the rotary bushing 52. A spiral oil pump 67 is mounted under the lower end of the lower shaft section 23 and the driven shaft 63. The gear box 60 contains lubricant which can be delivered by the pump 67 through a channel 28 to the main shaft 23, each bearing, and gear, to reduce friction therebetween, and then returned to the gear box 60 via a return pipe 68. The return pipe 68 is fitted with a transparent inspection tube 69 outside the gear box so as to allow the checking of the circulation and amount of the lubricant.

In the embodiment shown in FIG. 1-2, a grinding ring 59' is formed integrally with the support seat 53. Therefore, the grinding ring seat 152 shown in FIG. 1 or FIG. 1-1 is not required. The grinding ring 59' extends upwardly and has a portion having a v-shaped cross-section. A V-shaped annular recess is formed on the inside of the grinding ring 59' so that a grinding roller 57' can extend therein. The grinding roller 57' has a V-shaped cross-section portion which can extend into the annular recess in the grinding ring 59' so that raw material can be cut and ground between the grinding ring 59' and the grinding roller 57'. The clearance between the grinding ring 59' and the grinding roller 57' can be changed by adjusting the adjustable screw 581. The support plate 54 has an outwardly extended portion at the lower end thereof so as to support the adjustable screw 581, the spring 584 and the associated parts.

The operation of the invention will be described in detail hereinafter.

The motor is actuated to cause the driven shaft 63 and the lower shaft section 23 to rotate the fan 30, the classifying means 4 and driving gear 62 which are mounted coaxially on the main shaft 2. Then the rotary bushing 52 rotates at the low speed because of the rotation of the gears 66, 61, 65, 64, 623, and 622, thus the support seat 53 secured to the rotary bushing 52 will rotate about the lower shaft section 23. The raw material is fed through the feed inlet 141 into the mill 1 to drop down on the clearance between the grinding ring 59 and the grinding rollers 57 and be ground into particles. Since no friction will occur between the grinding rollers 57 and the grinding ring 59, the grinding roller means 5 can be started easily and quickly without requiring high power. The particles are carried in an upwardly spiralling air of stream created from the air inlet pipe 158 by the fan 30, through deflection plates 144 (FIG. 2), to the classifying means 4 where particles of the desired size are drawn through the finished product inlet 131 into the fan chamber and then are discharged through the exhaust pipe 132 to a cyclone separator not shown in the figures. The coarser and heavier particles are thrown against the inner wall of the central mill cylinder 14 due to the centrifugal force produced by the classifying means 4 without being carried upwardly in the aforesaid upwardly spiralling air stream, and drop down to the grinding zone for further reduction in size. The oversized particles or any material which is hard to grind will fall under the influence of gravity through the space between the grinding ring 59 and the central mill cylinder 14, and the deflection plates 144, to the bottom of said lower mill cylinder 15 where radially extending sweeping sheets 538 secured to the circular seat portion 532 will sweep such material to the waste material discharge port 159 and discharge the same through waste material discharge duct 160.

In operation, the pump 67 under the driven shaft 63 and the lower shaft section 23 forces the lubricant in the gear box through the channel 28 into the clearance between the lower shaft section 23 and rotary bushing 52, and then into the clearance between the rotary bushing 52 and the fixed sleeve 51 to lubricate the bearings. Thereafter the lubricant is returned via the return pipe 68 into the box 60 for recirculation. Depending on the desired fitness of the finished particles and the desired degree of wearing of the grinding rollers 57, the clearance between the grinding ring and rollers can be changed by adjusting the adjustable screws 580, 581 and the number of separate vanes 43 of the classifying means 4 changes. To be more specific, the smaller the aforesaid clearance is the more separate vanes are used, and the finer the finished particles will be; otherwise, the finished particles will be coarser.

Also, depending on the type and nature of the raw material to be ground, the clearance between the grinding ring and rollers can be adjusted to optimize the grinding effect. In case the clearance widens due to wear of the grinding surface of the rollers caused by long periods of use, such a disadvantage can be overcome the adjusting the adjusting the adjusting screws 580, 581 to adjust the position of the grinding rollers.

Moreover, in the event of a loss of power during operation, since the fan 30 stops, the raw material and ground particles left within the mill will drop down on the bottom of the mill and will be swept to the waste material discharge duct 159 by sweeping sheets 538 driven by virtue of the inertia of the rotary bushing 52 without plugging between the grinding ring and rollers. Thus as soon as the power supply resumes, the mill can start easily without causing any noise and damage to the motor which requires clearing of the residual raw material and ground particles within the mill cylinder. In addition, in case of wear each grinding roller 57 can be easily and quickly removed for repair or replacement by opening the inspection door 101 and removing the nut 572.

With the above advantages and reasonable designs, the invention is of great industrial value.

Although the present invention has been described in connection with a preferred embodiment thereof, it will be appreciated by those skilled in the art that modifications and changes may be made without departing from the spirit and scope of the invention as defined in the appended claims.

I claim:

1. A grinding mill comprising a mill cylinder, a vertically mounted main shaft coupled at the lower end to a motor mounted on the lower side of the mill cylinder to be driven thereby and extending along the axis of the mill cylinder, and means mounted in descending order on the main shaft including a finished product conveying means, a classifying means, a grinding roller means and a decelerating means, a fixed sleeve fixed on the bottom of the mill cylinder to support a rotary bushing by means of bearings, a circular seat portion and a support seat fixed to the upper end of the rotary bushing, wherein the support seat is fixed with a grinding ring, a plurality of grinding rollers are rotatably provided inward of the grinding ring, a clearance is formed between the grinding ring and the grinding rollers, wherein a plurality of radially extended sweeping sheets are provided outside of the circular seat portion for sweeping the material fallen upon it away from the mill, and wherein an air inlet duct is provided at the inner surface of the mill cylinder for directing air into a grinding chamber, wherein the grinding roller means is provided at a central section of the mill cylinder, characterized in that at least one inspection door is provided on the mill cylinder, the inspection door is hingedly secured with a grinding roller support plate which extends radially inwardly from outside of the inspection door for supporting the grinding roller, a pressurizing means is provided on the grinding roller support plate.

2. A grinding mill as defined in claim 1, characterized in that the inspection door is provided with a hinge member which can be fitted with a hinge portion provided on the grinding roller support plate so that the grinding roller support plate can pivotably move radially inwardly and outwardly, and characterized in that the lower end of the grinding roller support plate can extend radially inwardly into the mill cylinder from outside of the inspection door and provided with the grinding roller of an appropriate orientation, wherein a pressure plate is provided on the outside lower end of the grinding roller support plate.

3. A grinding mill as defined in claim 1, characterized in that the grinding roller support plate is provided with a space therein for reserving oil which lubricates the grinding rollers and the parts connected therewith, and characterized in that an oil inspection stick is provided on the upper end of the grinding roller support plate, and a transparent glass is provided on the lower end thereof.

4. A grinding mill as defined in claim 1, characterized in that the classifying means comprises an obliquely positioned double-disk rotary member coupled to the main shaft, and wherein a round plate is fixed to the lower end of the axis of the rotary member.

5. A grinding mill as defined in claim 1, characterized in that the classifying means comprises an obliquely positioned double-disk rotary member coupled to the main shaft and formed with a plurality of obliquely and radially disposed separation blades removably engaged along one side within a plurality of notches in the disks of the rotary member.

6. A grinding mill as defined in claim 1, characterized in that the grinding ring has a portion having a V-shaped annular recess and the grinding roller has a portion having a V-shaped cross-section for being received in the annual recess.

7. A grinding mill as defined in claim 1, characterized in that the support plate has an outwardly extended portion at the lower end thereof so as to support an adjustable screw, and a spring for adjusting the clearance between the grinding roller and the grinding ring.

8. A grinding mill as defined in claim 1, characterized in that the grinding ring is formed integrally with the support seat, the grinding ring extends upwardly and has a portion having a V-shaped cross-section.

* * * * *